US006494075B1

(12) United States Patent
Pelech, Jr.

(10) Patent No.: US 6,494,075 B1
(45) Date of Patent: Dec. 17, 2002

(54) DEVICE FOR SECURING A PUNCH TO A PRESS BRAKE

(76) Inventor: Bruno J. Pelech, Jr., 17350 Antler Dr., Orland Park, IL (US) 60467

( * ) Notice: Subject to any disclaimer, the term of this patent is extended or adjusted under 35 U.S.C. 154(b) by 0 days.

(21) Appl. No.: 09/908,263

(22) Filed: Jul. 18, 2001

(51) Int. Cl.[7] ..... B21D 37/14

(52) U.S. Cl. ..... 72/481.1; 72/389.3; 72/481.3

(58) Field of Search ..... 72/481.6, 481.1, 72/481.2, 481.3, 481.7, 482.2, 482.6, 389.3, 389.6, 414

(56) References Cited

U.S. PATENT DOCUMENTS 4,506,538 A * 3/1985 Jones, Jr. ..... 72/481.6
4,895,014 A * 1/1990 Houston ..... 72/481.1
4,912,961 A * 4/1990 Brown ..... 72/462
5,245,854 A * 9/1993 Bruggink et al. ..... 72/481
6,266,992 B1 * 7/2001 Butcher et al. ..... 72/478

FOREIGN PATENT DOCUMENTS

FR 2598946 * 11/1987 ..... 72/482.91

* cited by examiner

*Primary Examiner*—David Jones
(74) *Attorney, Agent, or Firm*—Cherskov & Flaynik

(57) ABSTRACT

A device 10 for securing a punch 13 to a press brake 44 includes a first member 12 removably inserted into an aperture 32 in the punch 13, a second member 14 integrally joined to the first member 12, a set screw 18 extending through the first and second members 12 and 14 to ultimately engage a wall 64 of the aperture 32 to maintain the horizontal position of the first and second members 12 and 14 relative to the punch 13, an extension portion 36 of the second member 14 that ultimately engages a cooperating portion 42 of the press brake 44, and a lip portion 46 that horizontally positions the extension portion 36 adjacent to a top wall 26 of the punch 13 thereby promoting accurate engagement with the cooperating portion 42 of the press brake 44.

19 Claims, 11 Drawing Sheets

DEVICE FOR SECURING A PUNCH TO A PRESS BRAKE

BACKGROUND OF THE INVENTION

1. Field of the Invention

The present invention relates to a punch secured to a press brake and more particularly, to a device for securing the vertical position of a punch relative to a press brake.

2. Background of the Prior Art

A punch-press brake combination is routinely utilized to form strips or sheets of metal into a myriad of configurations. Referring to FIG. 1, a side elevation view of a typical prior art punch-press brake installation is depicted. The press brake 4 includes a channel member 5 bolted to a base member 6 with a punch 7 positioned between a holding wall 8 of the channel member 5 and a base wall 9 of the base member 6. The punch 7 is vertically held in place by a plurality of tightened horizontal clamping screws that horizontally "squeeze" the punch between the holding and base walls 8 and 9 of the press brake 4.

The problem with this securing method is that the punch 7 is often comprised of multiple sections that have a tendency to loosen and slip downward causing an unacceptable deforming of the metal strips or sheets. Some press brakes 4 have press beds that can exceed twelve feet in length thereby requiring multiple punches or punch segments 7 of a predetermined form to be longitudinally aligned to configure a metal workpiece covering the length of the press bed. These punches 7 often have lengths that dispose a punch 7 in the press brake such that the ends of the punch are positioned from the bolts joining the channel member 5 to the base member 6, a distance that allows a punch end to slip downward and become misaligned during assembly of the punch-brake press combination. Some relatively small punch segments have longitudinal dimensions measuring less than the distance separating adjacent bolts making these small segments unusable.

Another problem with the prior method of securing the punch 7 to the press brake 4, is that safety is comprised when an operator places their hands beneath a punch 7 that might slip from the press brake 4. Government agencies (OSHA) and insurance companies have addressed the safety issue by requiring a safety "tongue" to be machined into the upper portion of a punch 7.

A need exists for a device that quickly, economically and safely secures a predetermined punch 7 to a press brake 4. Further, the device must be readily secured to a press brake 4 such that the vertical position and the job performance of the punch 7 is maintained without any modifications to the press brake 4.

SUMMARY OF THE INVENTION

It is an object of the present invention to overcome many of the disadvantages associated with a punch being secured to a press brake.

A principle object of the present invention is to provide a device that secures and vertically maintains a punch within a press brake. A feature of the device is an extension portion or "punch tongue" that protrudes beyond a vertical wall of the punch. An advantage of the device is that the extension portion is a relatively "simple way" to secure the punch to the press brake.

Another object of the present invention is to provide a device that secures a punch to a press brake without modifying the press brake. A feature of the device is an extension portion dimensioned to insert in relatively small existing spaces in a press brake. An advantage of the device is that no modification costs for the press brake are required.

Yet another object of the present invention is to provide a device that requires a small quantity of components to secure the device to the punch. A feature of the device is a substantially cylindrically configured first member that snugly inserts into a correspondingly configured aperture in a top portion of the punch. An advantage of the device is that installation costs are minimized.

Still another object of the present invention is to provide a device that includes a solid "unibody" construction. A feature of the device is a second member integrally joined to the first member. An advantage of the device is that no components are present that can "work free" and allow the punch to move vertically downward.

Another object of the present invention is to provide a device that has a first member vertically secured in an aperture in a top portion of the punch and a second member that engages a top wall of the punch. A feature of the device is slot formed in a top wall of the punch due to the relatively close proximity of an aperture to the top wall of the punch. An advantage of the device is that the first member can be vertically secured to the punch without requiring added components. Another advantage of the device is that a protruding portion of the first member can be disposed in the slot and be ultimately joined to the second member such that a bottom wall of the second member engages a top wall of the punch thereby positioning the second portion to engage the press brake.

Another object of the present invention is to provide a device that allows "scrap" punches to be reused in a relatively large press brake. A feature of the device is it's relatively small size. Another feature of the device is that it is relatively inexpensive to fabricate. An advantage of the device is that multiple device can be installed along the top portion of a punch as required to insure that the punch is vertically secured in a press brake.

Another object of the present invention is to provide a device that limits horizontal movement when a first member is inserted into an aperture in a top portion of a punch. A feature of the device is a lip portion that ultimately engages a top portion of a vertical side wall of a punch. An advantage of the device is that a bottom wall of the lip portion is correctly disposed to engage a cooperating portion of a press brake to vertically secure the device and the punch.

Another object of the present invention is to provide a device that maintains the horizontal position of a first member upon being inserted into an aperture in the top portion of the punch. A feature of the device is a countersunk set screw centrally disposed through the joined first and second members such that a rounded end of the set screw protrudes past a bottom portion of the first member to forcibly engage a wall portion of the aperture thereby frictionally joining top walls of the first member with cooperating wall portions of the aperture. An advantage of the device is that the first member cannot slip from the aperture in the punch when the punch is being secured to corresponding portions of the press brake during the machine "set-up" process.

Briefly, the invention provides a device for securing a punch to a press brake comprising a first member; a second member integrally joined to said first member; means for removably securing said first member to the punch; means for removably securing said second member to a cooperating portion of the press brake; and means for maintaining a predetermined position of said integrally joined first and second members relative to the punch.

BRIEF DESCRIPTION OF THE DRAWINGS

These and other objects, advantages and novel features of the present invention, as wall as details of an illustrative embodiment thereof, will be more fully understood from the following detailed description and attached drawings, wherein.

DETAILED DESCRIPTION OF THE PREFERRED EMBODIMENT

Figure 1:
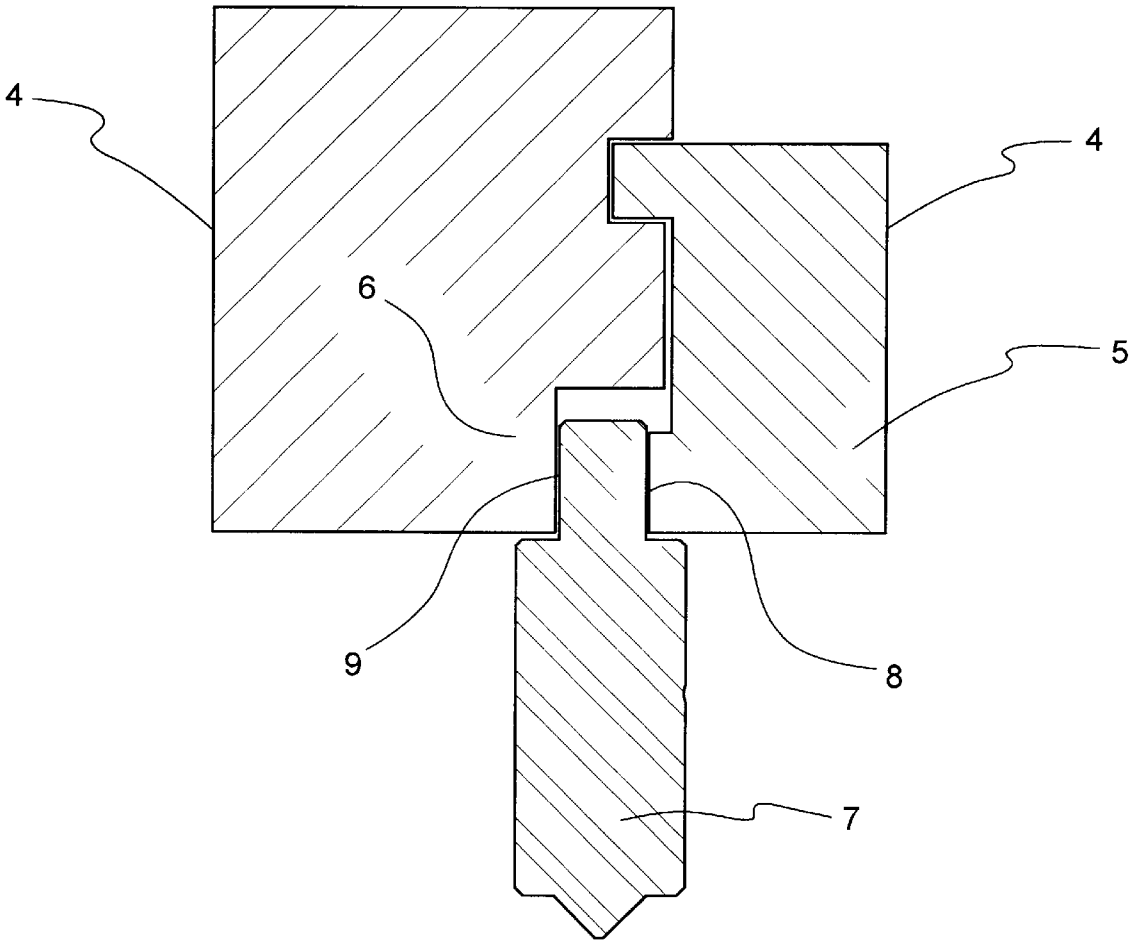
Prior Art Fig. 1
FIG. 1 is a side view of a prior method of securing a punch between cooperating portions of a press brake.
Figure 2:
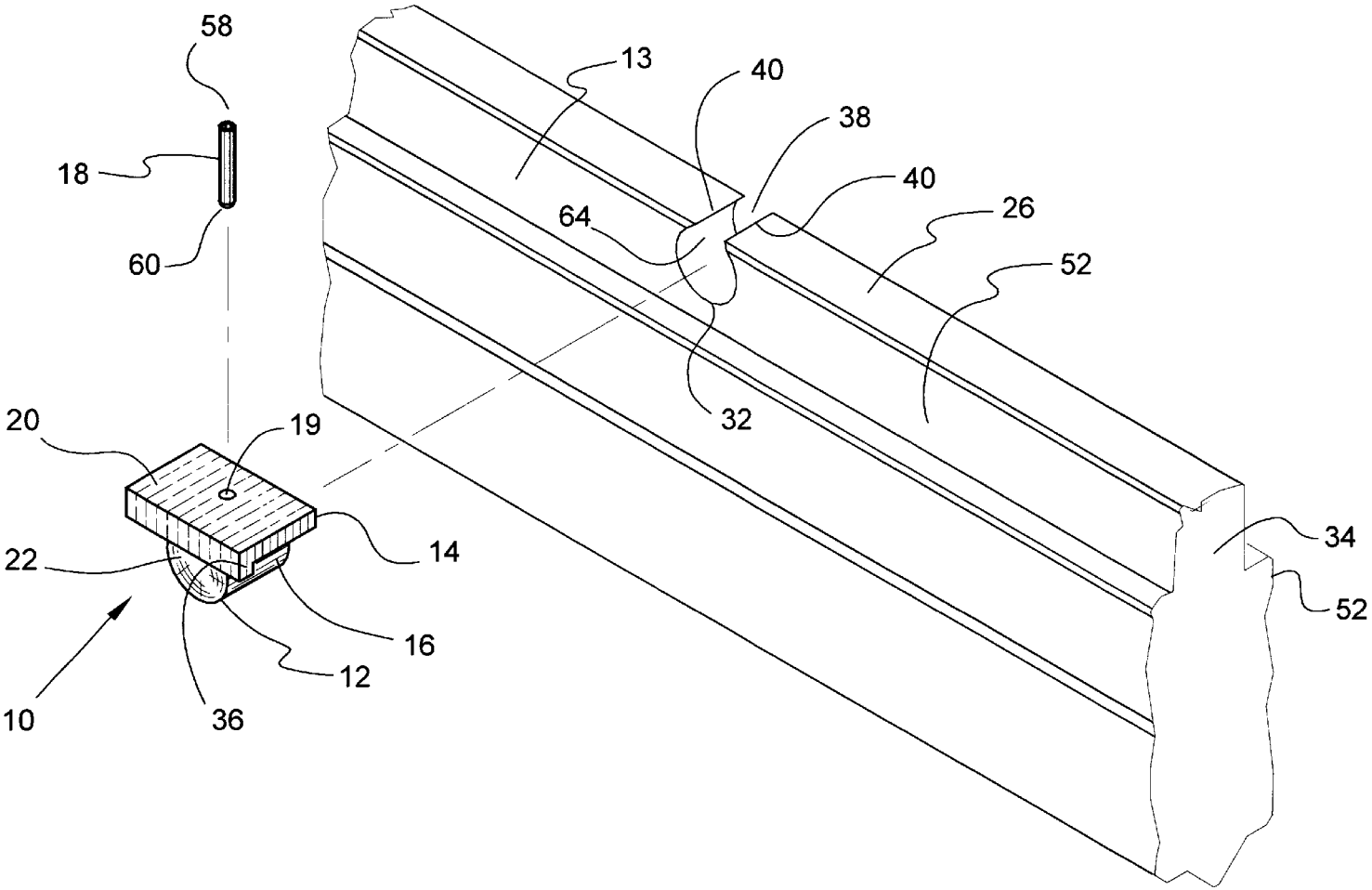
FIG. 2 is an exploded perspective view of a device for securing a punch to a press brake in accordance with the present invention.
Figure 3:
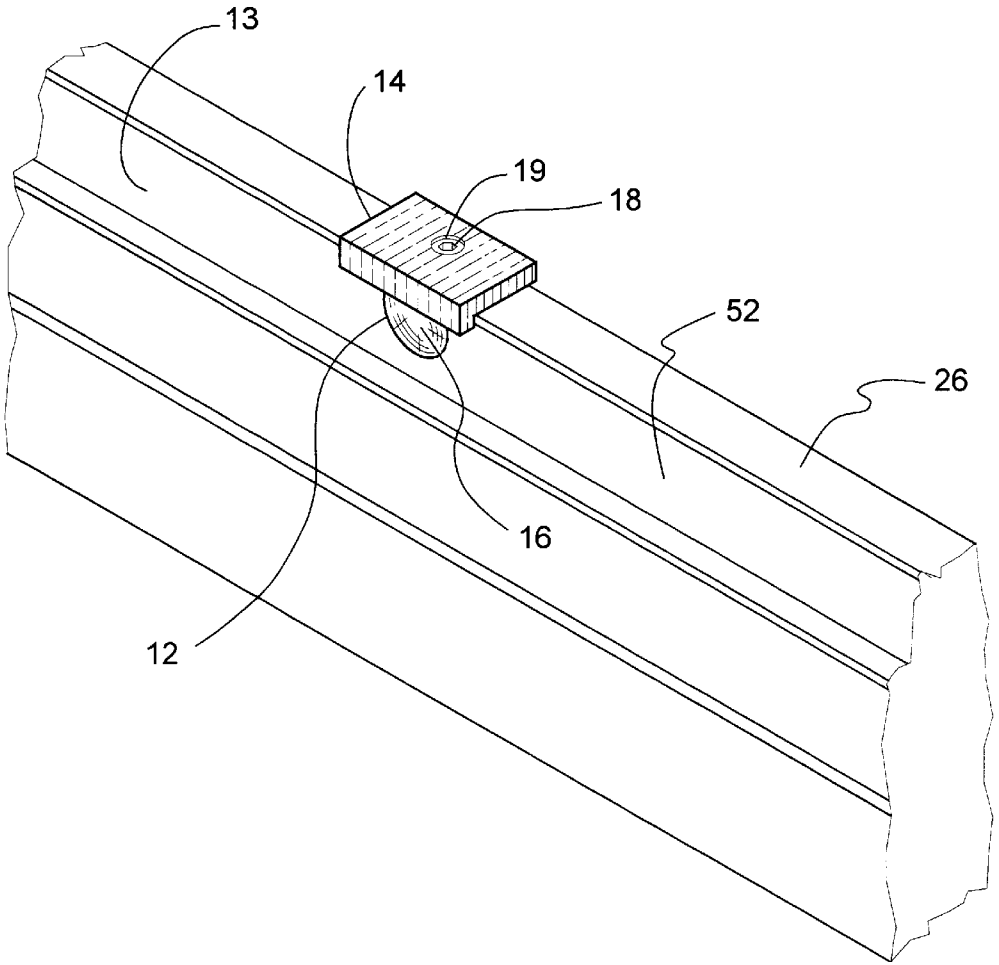
FIG. 3 is a perspective view of the device of FIG. 1, secured to a punch in accordance with present invention.
Figure 4:
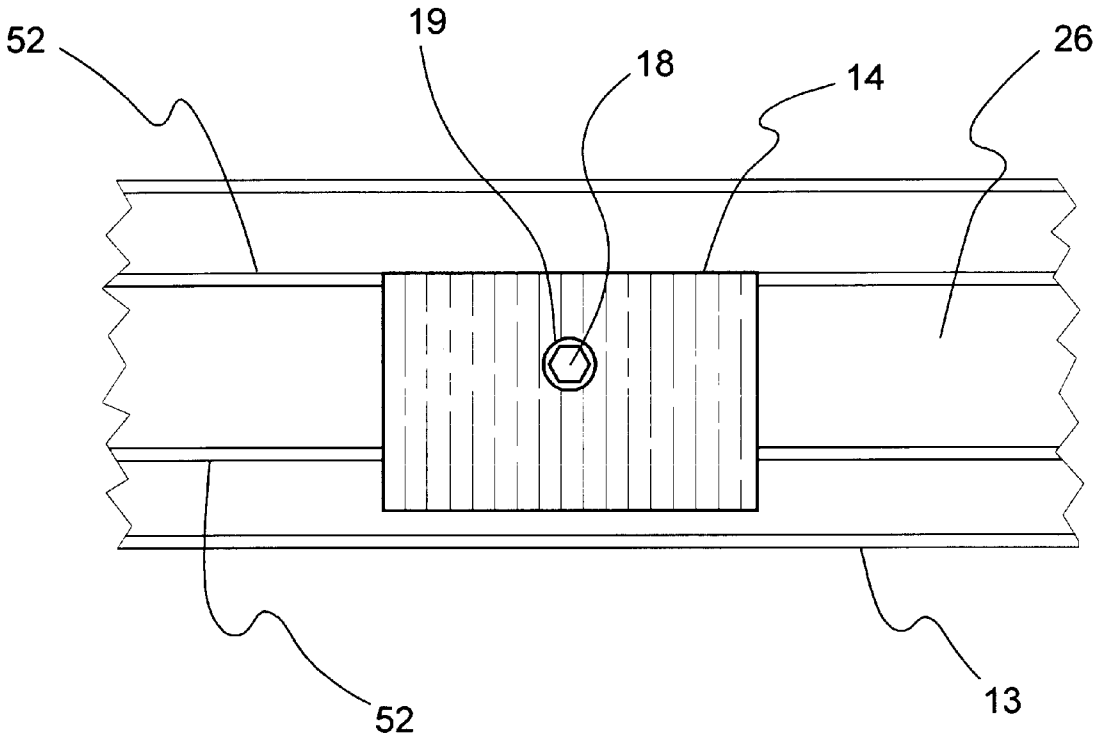
FIG. 4 is a top elevation view of the device and punch of FIG. 2.
Figure 5:
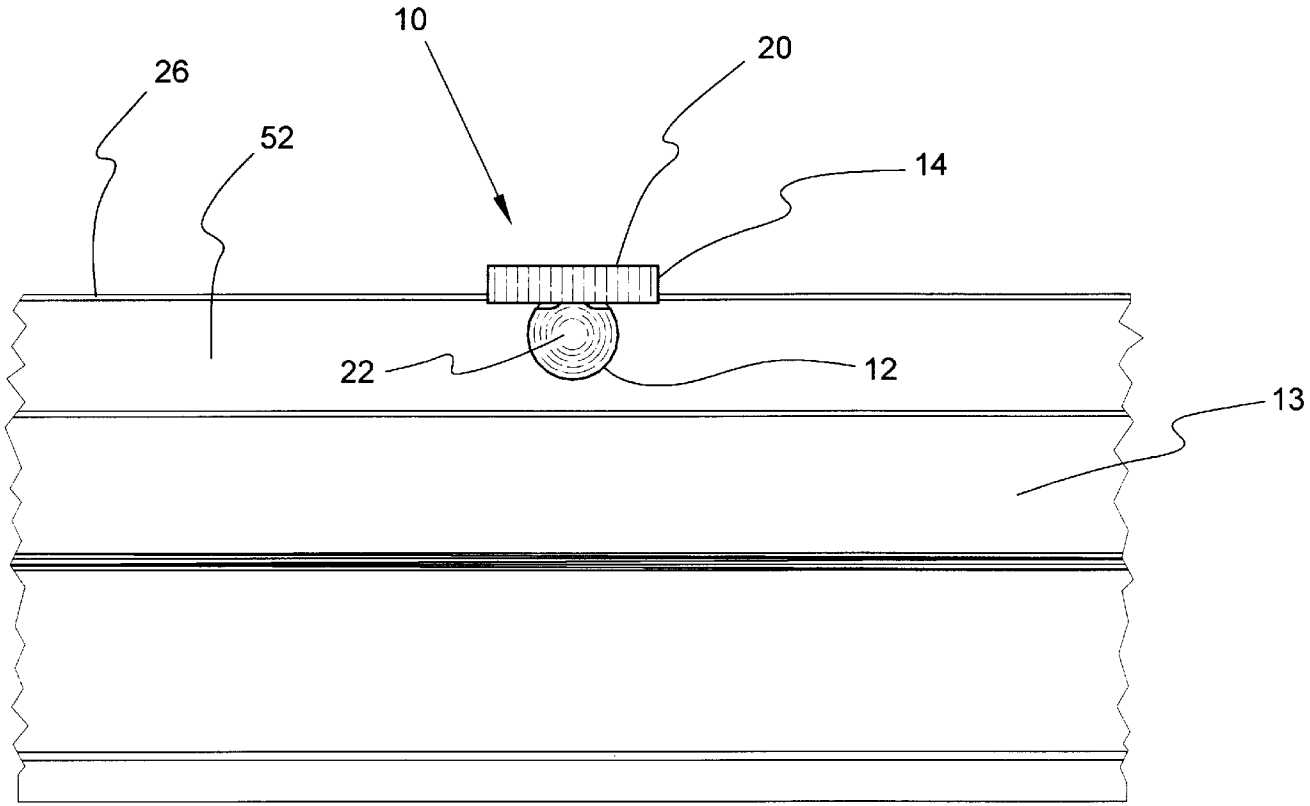
FIG. 5 is a front elevation view of the device and punch 2.
Figure 6:
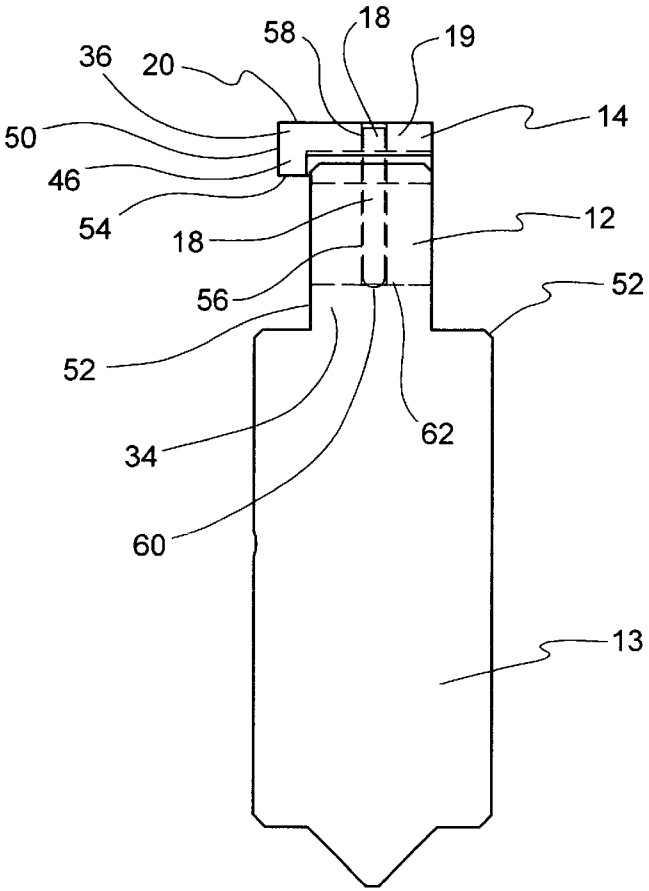
FIG. 6 is a side elevation view of the device and punch of FIG. 2.
Figure 7:
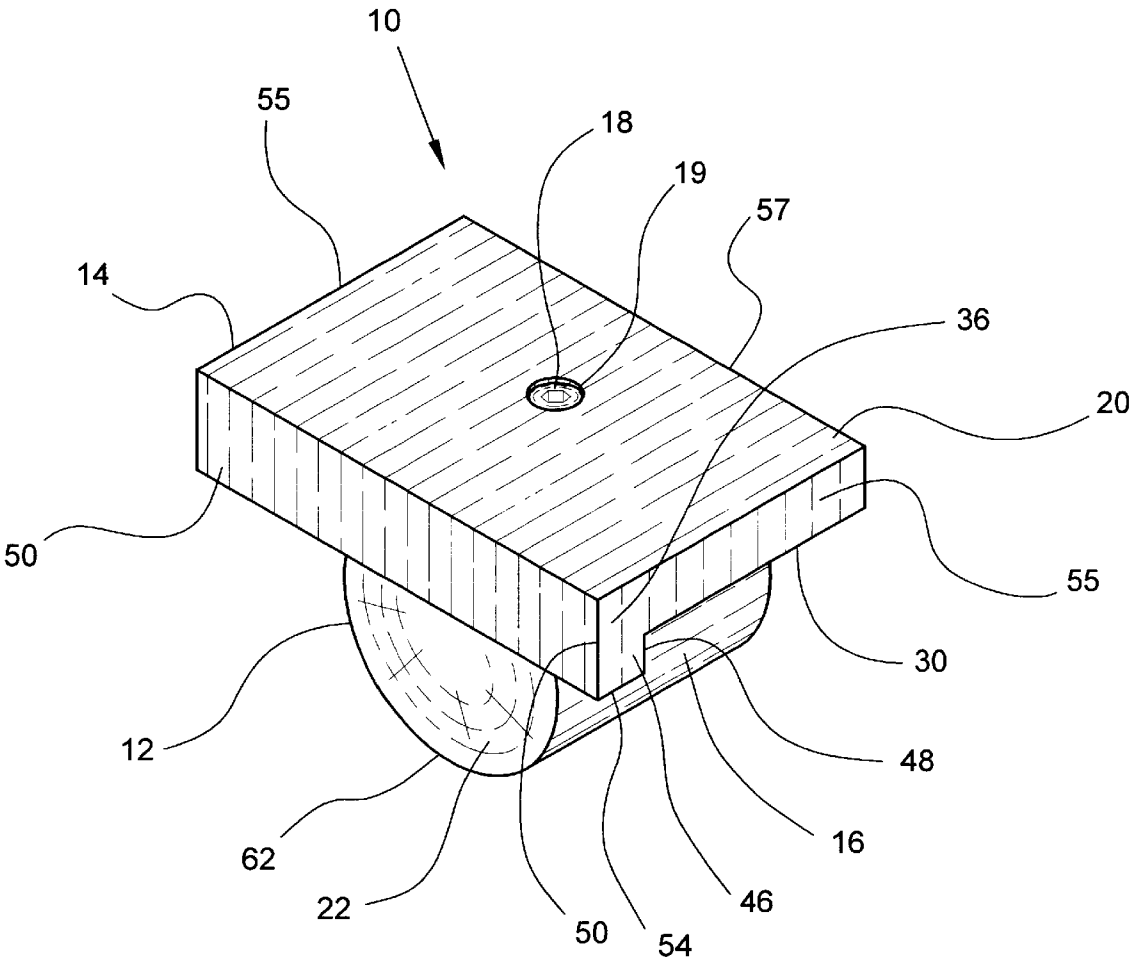
FIG. 7 is a perspective view of the device in accordance with the present invention.
Figure 8:
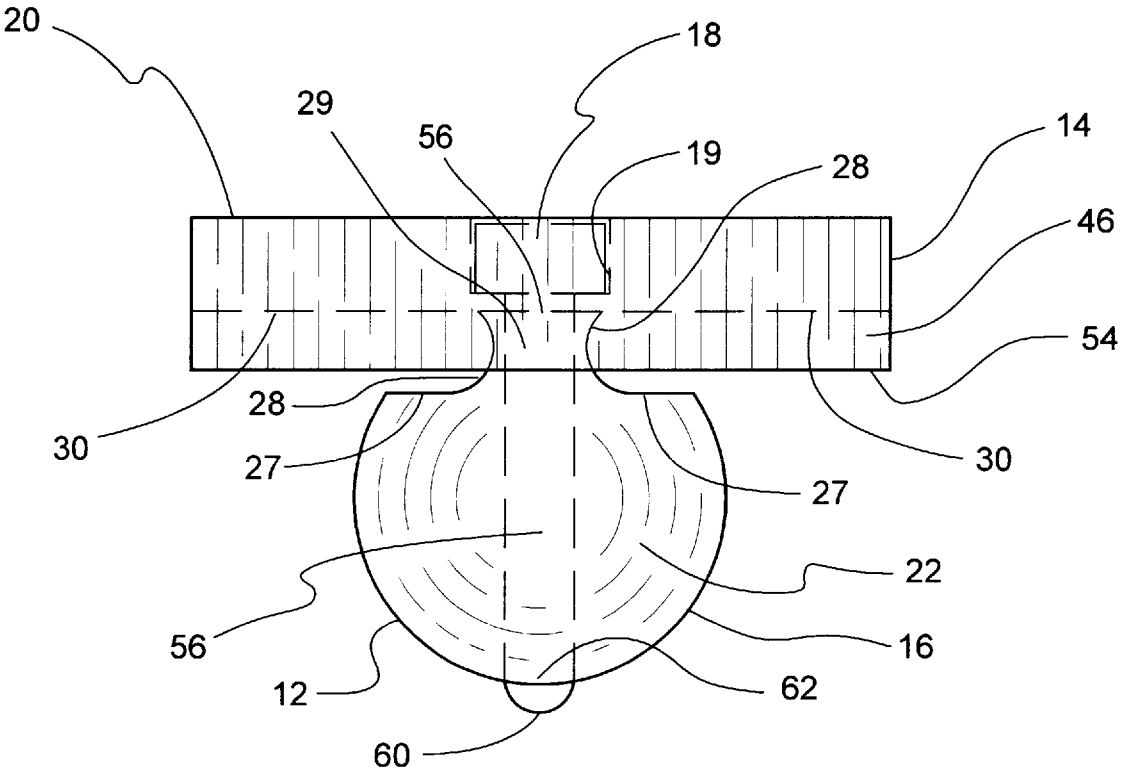
FIG. 8 is a front elevation of the device of FIG. 7.
Figure 9:
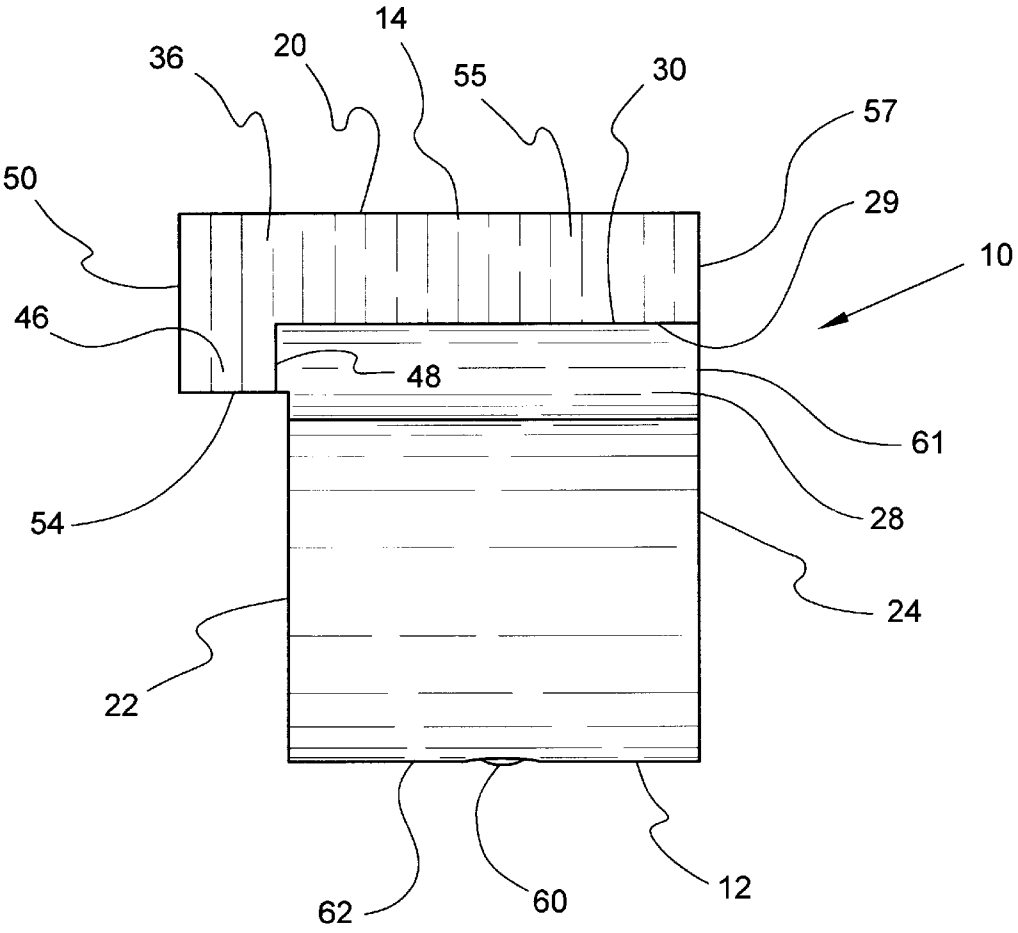
FIG. 9 is a side elevation of the device of FIG. 7.
Figure 10:
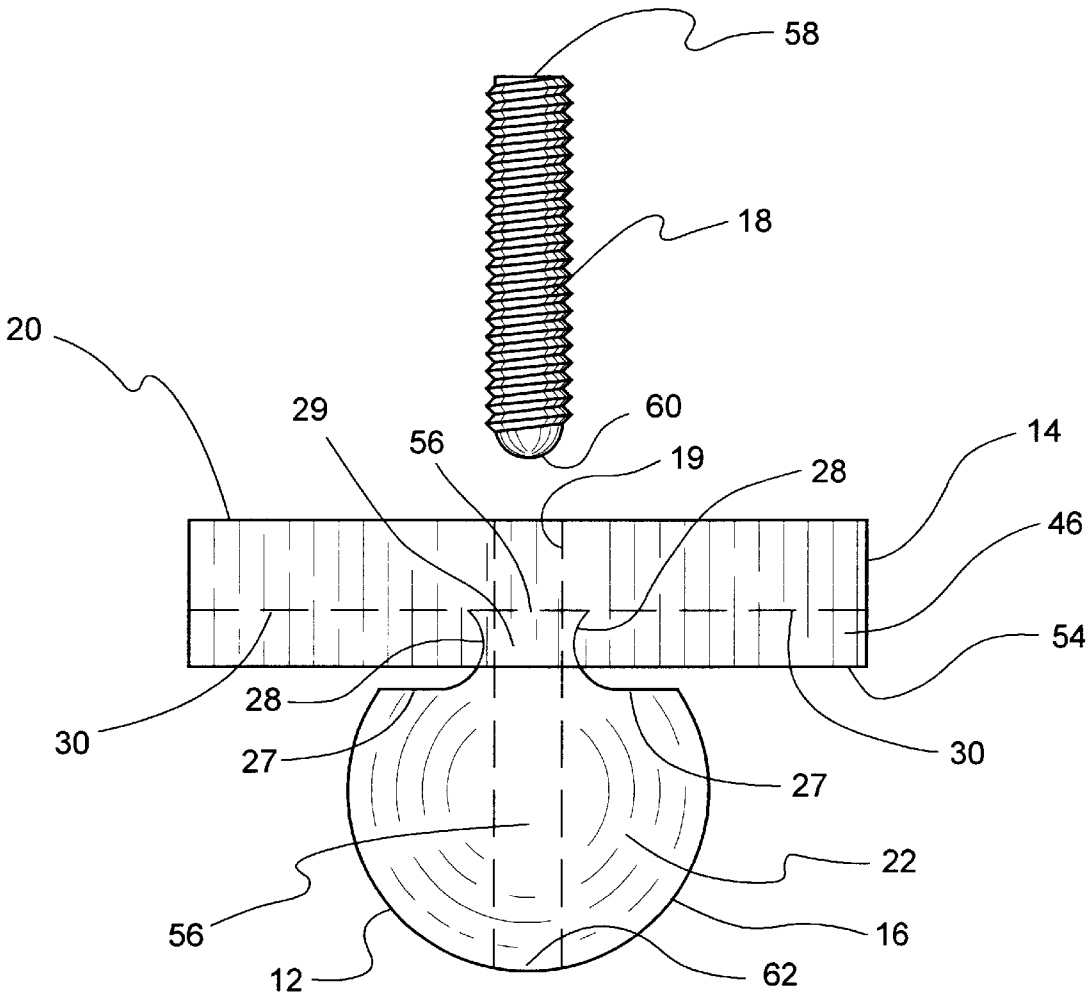
FIG. 10 is an exploded, phantom view of the device of FIG. 8.
Figure 11:
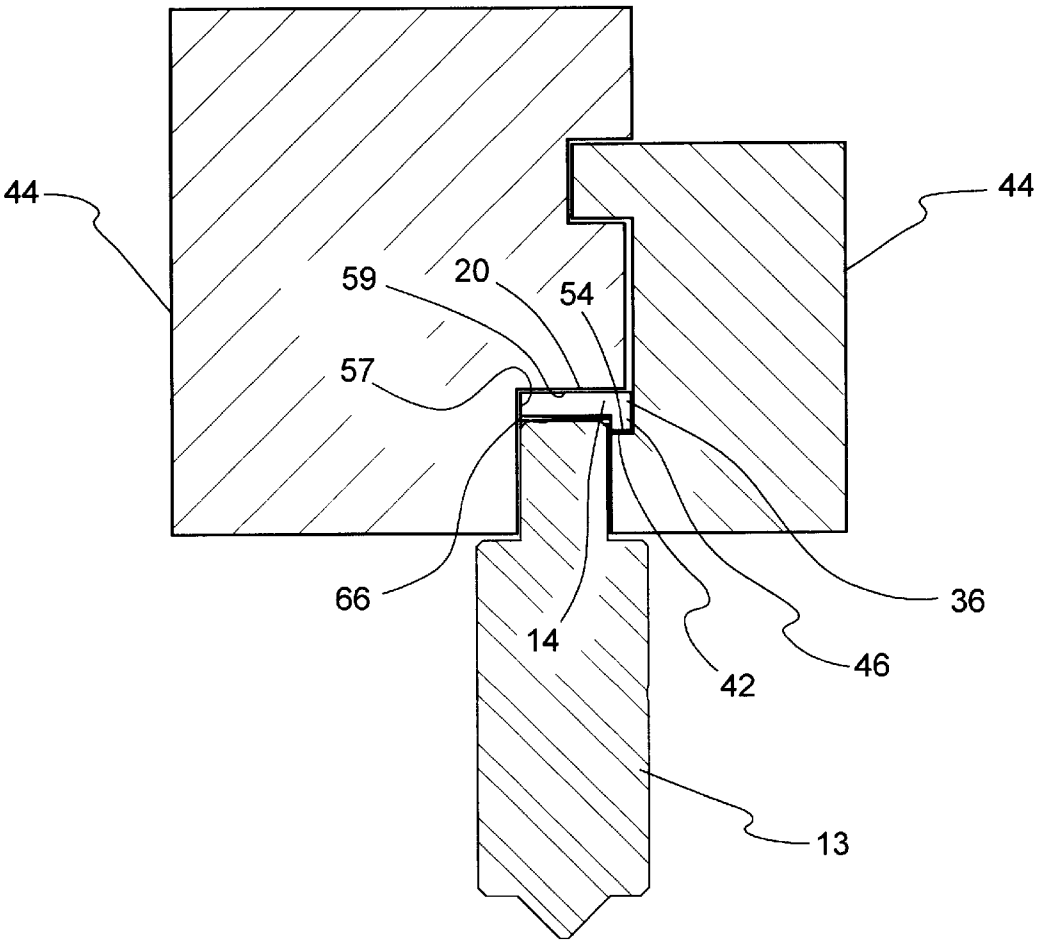
FIG. 11 is a side elevation view of the device and punch secured to a press brake.

Referring now to the figures, a device or "punch tongue" for securing a punch to a press brake is denoted by numeral 10. The device 10 may be fabricated from a myriad of steel metals with the metal of preference being 1018 carbon steel. The device 10 includes a substantially cylindrical first member 12 that is removably joined to the punch 13, a relatively planar, rectangularly configured second member 14 that is integrally joined to a relatively cylindrical side wall 16 of the first member 12, and a counter sunk securing screw or set screw 18 centrally disposed beneath a top wall 20 of the second member 14 via a recess 19; the screw 18 extending through the joined first and second members 12 and 14 to ultimately maintain the position of the device 10 relative to the punch 13 (not part of the invention).

The first member 12 includes inner and outer planar walls 22 and 24 separated via the cylindrical side wall 16, a predetermined distance substantially equivalent to the lateral dimension of a top wall 26 of the punch 13. The first member 12 includes two substantially horizontal, planar top walls 27, each joining with the cylindrical side wall 16 and a protruding top portion 28. Alternatively, the cylindrical side wall 16 can continue until joining with the top portion 28, thus eliminating the two top walls 27. The top portion 28 includes a planar top wall 29 that extends horizontally between the inner and outer walls 22 and 24 of the first member 12. The top wall 29 includes a lateral dimension that cooperates with the longitudinal dimension to provide sufficient surface area to facilitate the integral joining of the top wall 29 to a central portion of a bottom planar wall 30 of the second member 14. The walls 29 and 30 are integrally joined together via welding or similar means to form a solid, "unibody" device 10.

The first member 12 is dimensioned to promote the snug insertion of the first member 12 into a cooperating, substantially cylindrical aperture 32 in a top portion 34 of the punch 13. The aperture 32 extends laterally through the top portion 34, and is disposed adjacent to the top wall 26 such that a lateral slot 38 is formed through the top wall 26 of the punch 13. The slot 38 is dimensioned to allow the protruding top portion 28 of the first member 12 to be snugly disposed between opposing edges 40, and to prevent the first member from escaping the aperture 32 in a vertical direction. Further, the aperture and slot 32 and 38 cooperate with the cylindrical side wall and protruding top portion 16 and 28 of the first member 12, to position the second member 14 such that the bottom wall 30 of the second member 14 engages the top wall 26 of the punch 14.

The second member 14 includes an extension portion 36 that protrudes a predetermined horizontal distance past the inner wall 22 of the first member 12 to ultimately engage a cooperating portion 42 of a press brake 44 (not part of the invention) thereby securing the vertical position of the punch 13. The extension portion 36 includes a lip portion 46 configured from inner and outer planar side walls 48 and 50 perpendicularly joined to corresponding bottom and top walls 30 and 20 of the second member 14. The inner side wall 48 of the lip portion 46 ultimately engages a side wall 52 of the top portion 34 of the punch 13 as the first member 12 is inserted into the aperture 32 thereby restricting continued horizontal movement of the first member 12 and accurately positioning a bottom wall 54 of the lip portion 46 to engage the cooperating portion 42 of the press brake 44. The longitudinal dimension of the outer side wall 50 and the lateral dimension of the bottom wall 54 cooperate to provide a sufficient surface area that allows the device 10 to vertically support the punch 13 when the device 10 is secured to the press brake 44. The longitudinal dimension of the outer side wall 50 is substantially about twice the diameter of the side walls 22 and 24 of the first member 12.

The second member 14 further includes a pair of parallel, planar, adjacent side walls 55 that are perpendicularly joined to the outer wall 50 of the lip portion 46. The adjacent side walls 55 are longitudinally dimensioned to position a back side wall 57 of the second member 14 coplanar with the outer wall 24 of the first member 12 and an outer wall 61 of the top portion 28 of the first member 12. The coplanar orientation of the back side wall 57 and the outer walls 24 and 61 establishes vertical alignment with the side walls 52 of the top portion 34 of the punch 13. This "flush" arrangement of the walls promotes engagement between the punch 13 and the press brake 44.

The securing screw 18 is threaded into a cooperating aperture 56 that is axially aligned with the recess 19 and extends perpendicularly through the second member 14 via top and bottom walls 20 and 30, and radially through the first member 12 via the top wall 29 of the protruding portion 28. The securing screw 18 is typically an "Allen" screw having a head portion 58 that is countersunk beneath the top wall 20 in the centrally disposed recess 19 of the second member 14. The countersunk screw 18 prevents engagement between the head portion 58 of the screw 18 and a corresponding portion 59 of the press brake 44. The securing screw 18 includes a longitudinal dimension sufficient to position a relatively smooth, rounded end 60 of the screw 18 beyond the periphery of a lower portion 62 of the first member 12 to un-abrasively, yet forcibly engage a cooperating portion of a cylindrical wall 64 of the aperture 32 in the upper portion 34 of the punch 13 thereby maintaining the horizontal position of the device 10 relative to the punch 13.

In operation, an aperture 32 is formed in a top portion 34 of a preselected punch 13 such that the longitudinal axis of the aperture 32 is perpendicular to a vertical side wall 52 of the top portion of the punch 13. The positioning of the aperture 32 relative to a horizontal top wall 26 of the punch 13, forms a slot 38 that facilitates the insertion of the device 10 into the aperture 32 whereby a first member 12 is snugly received by the aperture, a protruding top portion 28 of the first member 12 is disposed between opposing edges 40 of the slot 38, and a second member 14 is set upon the top wall 26 of the punch 13. The dimensioning of the slot 32 is such that the first member 12 cannot vertically escape the aperture 32. The axial dimension of the first member 12 positions inner and outer walls 22 and 24 of the first member 12 planar ("flush") with the vertical side walls 52 of the punch 13, thus providing a continuous smooth surface across the top portion 34 of the punch 13. The second member 14 includes an extension portion 36 that protrudes beyond the inner side wall 22 of the first member 12 to form a lip portion 46 that ultimately captures a portion of a side wall 52 of the punch 13 adjacent to the top wall 26 when the device 10 is inserted into the aperture 32 thereby preventing continued horizontal movement of the device 10. The position of the first and second member 12 and 14 is then secured relative to the punch 13 by inserting a countersunk set screw 18 through recess 19 and aperture 56 until a rounded end 60 of the screw 18 forcibly engages a portion of the wall 64 of the aperture 56 in the punch 13. The punch 13 is then secured to the press brake 44 by interlocking a bottom wall 54 of the lip portion 46 of the second member 14, and the top and backside walls 20 and 57 of the second member 14 with cooperating portions 42, 59 and 66 of the press brake 44, respectively.

The foregoing description is for purposes of illustrating only and is not intended to limit the scope of protection accorded this invention. The scope of protection is to be measured by the following claims, which should be interpreted as broadly as the inventive contribution permits.

What is claimed and desired to be secured by Letters Patent of the United States is:

1. A device for securing a punch to a press brake comprising:

a first member;

a second member integrally joined to said first member;

means for removably securing said first member to the punch, said first member securing means includes an aperture in the top portion of the punch, said aperture being dimensioned to snugly receive said cylindrically configured first member therein;

means for removably securing said second member to a cooperating portion of the press brake;

means for maintaining a predetermined position of said integrally joined first and second members relative to the punch.

2. The device of claim 1 wherein said first member includes a substantially cylindrical configuration.

3. The device of claim 1 wherein said second member includes a rectangular configuration when taking a top view of said device.

4. The device of claim 1 wherein said first member securing means includes a set screw.

5. The device of claim 4 wherein said set screw is disposed through said first and second members to ultimately engage a wall portion of the punch thereby maintaining the position of the joined first and second members relative to the punch.

6. The device of claim 5 wherein said set screw includes a rounded end.

7. The device of claim 5 wherein said set screw includes a countersunk head portion.

8. The device of claim 4 wherein said set screw is centrally disposed through a top wall of said second member.

9. The device of claim 1 wherein said first member includes an outer side wall that is coplanar with a corresponding side wall of the punch.

10. The device of claim 1 wherein said first member includes an inner side wall that is coplanar with a corresponding side wall of the punch.

11. A device for securing a punch to a press brake comprising:

a first member;

a second member integrally joined to said first member;

means for removably securing said first member to the punch;

means for removably securing said second member to a cooperating portion of the press brake, said second member securing means includes dimensioning said second member to provide an extension portion that engages a cooperating portion of the press brake whereby said second member is vertically captured by the cooperating portion of the press brake, said extension portion includes a lip portion having an inner side wall configured to engage a top portion of the punch to restrict horizontal motion of the second member relative to the punch;

means for maintaining a predetermined position of said integrally joined first and second members relative to the punch.

12. The device of claim 11 wherein said lip portion includes a bottom wall that engages a cooperating portion of the press brake.

13. The device of claim 11 wherein said lip portion includes an outer side wall that is disposed adjacent to a corresponding portion of the press brake.

14. A device for securing a punch to a press brake comprising:

a first member;

a second member integrally joined to said first member, said second member includes an outer side wall that is coplanar with a corresponding side wall of the punch;

means for removably securing said first member to the punch;

means for removably securing said second member to a cooperating portion of the press brake, said second member securing means includes dimensioning said second member to provide an extension portion that engages a cooperating portion of the press brake whereby said second member is vertically captured by the cooperating portion of the press brake; and means for maintaining a predetermined position of said integrally joined first and second members relative to the punch.

15. The device of claim 14 wherein said set screw is radially disposed through said first member.

16. A device for vertically securing a punch to a press brake comprising:

first and second members integrally joined together;

means for securing said first member to a predetermined portion of the punch;

means for securing said second member to a predetermined portion of the press brake; and means for maintaining the position of the punch relative to the press brake, said maintaining means includes disposing a wall of said first member planar with a corresponding side wall of the punch whereby cooperating portions of the press brake capture said device and the punch.

17. A method for securing a punch to a press brake, said method comprising the steps of:

providing first and second members integrally joined together;

securing said first member to a predetermined portion of the punch;

securing said second member to a predetermined portion of the press brake; and maintaining the position of the punch relative to the press brake, said position maintaining step including the step of dimensioning said first member to allow the press brake to capture the punch.

18. A device for securing a punch to a press brake comprising:

a first member, a second member integrally joined to said first member;

means for removably securing said first member to the punch;

means for removably securing said second member to a cooperating portion of the press brake, and means for maintaining a predetermined position of said integrally joined first and second members relative to the punch, said maintaining means includes axially dimensioning said first member such that an inner wall of said first member is disposed planar with a corresponding side wall of the punch to ultimately engage a cooperating portion of the press brake thereby promoting the capture of said device and the punch by the press brake.

19. A device for securing a punch to a press brake comprising:

first and second members rigidly joined together;

means for detach joining said first member to a predetermined portion of the punch such that said first member is prevented from moving relative to the punch; and means for detachably joining said second member to a predetermined portion of the press brake such that said second member is prevented from moving relative to the press brake whereby the punch is rigidly secured to the press brake.

* * * * *